US009180338B2

(12) United States Patent
Sorace

(10) Patent No.: US 9,180,338 B2
(45) Date of Patent: Nov. 10, 2015

(54) EXERCISE DEVICE FOR PUSH UPS

(71) Applicant: Edward Louis Sorace, Dawsonville, GA (US)

(72) Inventor: Edward Louis Sorace, Dawsonville, GA (US)

( * ) Notice: Subject to any disclaimer, the term of this patent is extended or adjusted under 35 U.S.C. 154(b) by 0 days.

(21) Appl. No.: 14/287,853

(22) Filed: May 27, 2014

(65) Prior Publication Data

US 2014/0357460 A1 Dec. 4, 2014

Related U.S. Application Data

(60) Provisional application No. 61/828,291, filed on May 29, 2013.

(51) Int. Cl.
*A63B 21/00* (2006.01)
*A63B 23/12* (2006.01)

(52) U.S. Cl.
CPC ..... *A63B 23/1236* (2013.01)

(58) Field of Classification Search
CPC ..... A63B 21/00
See application file for complete search history.

(56) References Cited

U.S. PATENT DOCUMENTS

| | | | | |
|---|---|---|---|---|
| 5,551,934 | A * | 9/1996 | Binette | 482/123 |
| 5,626,544 | A * | 5/1997 | Foresto | 482/124 |
| 6,402,667 | B1 * | 6/2002 | Dahn | 482/121 |
| 2003/0027698 | A1 * | 2/2003 | Matsuoka | 482/124 |
| 2003/0158021 | A1 * | 8/2003 | Prichard | 482/123 |
| 2004/0127339 | A1 * | 7/2004 | Finn | 482/140 |

* cited by examiner

*Primary Examiner* — Jerome w Donnelly
(74) *Attorney, Agent, or Firm* — Antonio Papageorgiou, Esq.

(57) ABSTRACT

An apparatus for push-ups is provided that includes a base comprised of one or more sockets, a pin, friction material supporting at least one rotatable handle with a hand support and friction cap having one or more resistance bands with eye hooks capable of being connected to a harness eye hook mounted on the front of a harness worn by an athlete to perform resistance push-ups without the need of a spotter.

14 Claims, 3 Drawing Sheets

EXERCISE DEVICE FOR PUSH UPS

CROSS REFERENCE TO RELATED APPLICATION

This application claims the priority of U.S. Provisional Application No. 61/828,291, entitled "EXERCISE DEVICE FOR PUSH UPS," filed on May 29, 2013, the disclosure of which is hereby incorporated by reference in its entirety.

COPYRIGHT NOTICE

A portion of the disclosure of this patent document contains material, which is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of the Invention

The invention described herein generally relates to an exercise device for push-ups. In particular, a device that allows an athlete to do weight bearing push-ups by using resistance for the weight load so that the athlete is able to do weight bearing exercises while alone without the need for a spotter.

2. Description of the Related Art

A push-up is a common calisthenics exercise performed in a horizontal position by raising and lowering the body using the arms. Push-ups exercise the muscles in the chest, shoulders, triceps, back, abs and even the legs. Push-ups are a basic exercise used in civilian athletic training or physical education classes and commonly used in military training.

A common push up is performed by (1.) getting on the floor and positioning your hands slightly wider than your shoulders. (2.) Next, rise up onto your toes so you are balanced on your hands and toes. (3.) Keep your body in a straight line from head to toe without sagging in the middle or arching your back. (4.) Your feet can be close together or a bit wider depending upon what is most comfortable for you. (5.) Before you begin any movement, contract your abs and tighten your core by pulling your belly button toward your spine. (6.) Keep a tight core throughout the entire push up. (7.) Inhale as you slowly bend your elbows and lower yourself until your elbows are at a 90 degree angle. (8.) Exhale as you begin pushing back up to the start position. (9.) Do not lock out the elbows; keep them slightly bent. (10.) Repeat for as many repetitions as your workout routine requires.

Many variations to the common push up, described above, can be performed. One such variation is for the athlete to add weight to the back. In this instance the athlete is increasing the work of the exercise by lifting more than just body weight during the push-up.

One such example is the placing of a weight plate, from a barbell, on the athletes back. Weight plates are readily available in most gymnasiums and work out training facilities. In this instance it is necessary to have a spotter available for the athlete to safely perform the push-ups. A spotter is a person needed to steady the weight on the athletes back to prevent a shifting of the weight load causing the athlete an injury.

Often times an athlete would like to perform push-ups, with a weight load, and is unable to do so because of the absence of a spotter. Accordingly there is a need for an exercise device for push-ups that overcomes some or all of the limitations of the absence of a spotter and allows an athlete to perform push-ups while working out alone.

SUMMARY OF THE INVENTION

The present invention provides an exercise device for push-ups that includes one or more handles; a base comprising one or more sockets extending essentially orthogonally from a plane of the base, the one or more sockets adapted for insertion of the one or more handles into the socket; a harness including an interconnected belt and at least one shoulder strap; and one or more resistance bands connected to the base and the harness.

In at least one embodiment, the base includes friction material adhered to the bottom of the base.

In at least one embodiment, the handle includes a friction cap inserted at one end of the one or more handles.

In at least one embodiment, the one or more handles is adapted to rotate up to 360 degrees about an axis of the one or more sockets.

In at least one embodiment, the harness is constructed of one of woven fabric, leather, and plastic.

In at least one embodiment, the one or more resistance bands are constructed of one of rubber and elastomer material.

In at least one embodiment, the one or more resistance bands are removably coupled to the base and the harness.

In at least one embodiment, one or more resistance bands are coupled to the base and the harness with one or more eye hooks that include a movable portion to allow connection with a pin on the base.

In at least one embodiment, the base measures about 6 inches by about 20 inches.

In at least one embodiment, the one or more handles are tubular members having an inverted U shape.

In at least one embodiment, the one or more handles are about 5 inches in height and about 8 inches in length.

In at least one embodiment, the one or more handles comprise a hand support that is about 6 inches in length and about 3.5 inches in diameter.

In at least one embodiment, the one or more resistance band measures about 0.5 inches in width and 6 inches in length.

In at least one embodiment, the one or more sockets comprise a cylinder about 1 inch inside diameter and about 2 inches in height.

BRIEF DESCRIPTION OF THE DRAWINGS

The invention is illustrated in the figures of the accompanying drawings which are meant to be exemplary and not limiting, in which like references are intended to refer to like or corresponding parts, and in which.

DETAILED DESCRIPTION OF THE INVENTION

Subject matter will now be described more fully hereinafter with reference to the accompanying drawings, which form a part hereof, and which show, by way of illustration, exemplary embodiments in which the invention may be practiced. Subject matter may, however, be embodied in a variety of different forms and, therefore, covered or claimed subject matter is intended to be construed as not being limited to any example embodiments set forth herein; example embodiments are provided merely to be illustrative. It is to be understood that other embodiments may be utilized and structural changes may be made without departing from the scope of the present invention. Likewise, a reasonably broad scope for claimed or covered subject matter is intended. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of exemplary embodiments in whole or in part.

Figure 1:
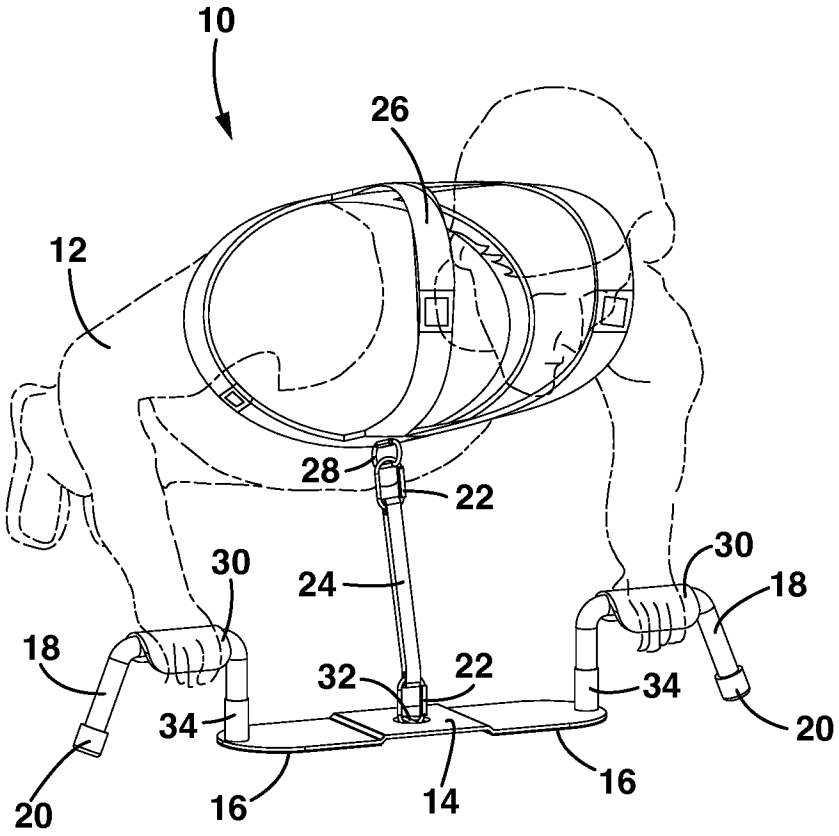
FIG. 1 is a perspective view of the exercise device for push-ups in use by an athlete.
Figure 2:
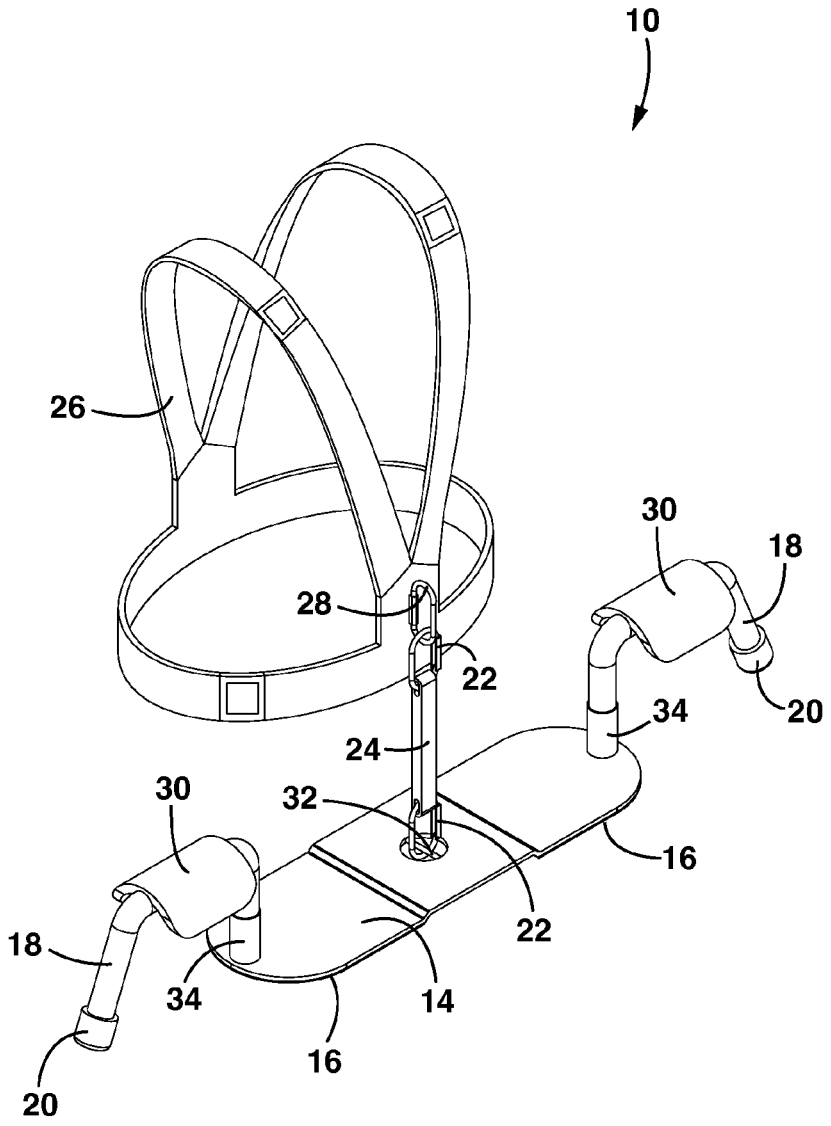
FIG. 2 is a perspective view of the exercise device for push-ups.
Figure 3:
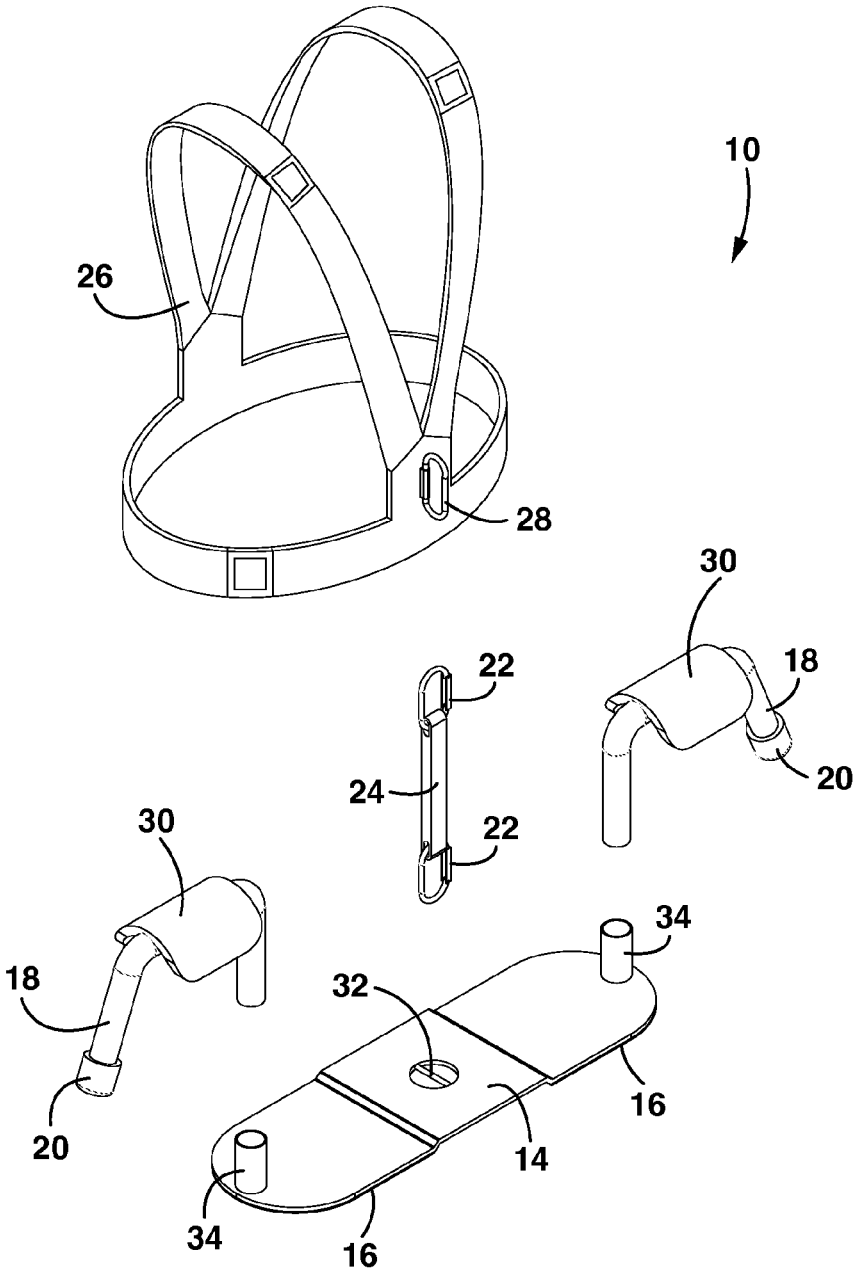
FIG. 3 is an exploded view of FIG. 2.

Referring to FIG. 1 through FIG. 3, various views of the exercise device for push-ups 10 according to at least one embodiment of the present device disclosed herein is shown.

An exercise device for push ups 10 is a device that allows an athlete 12 to do weight bearing push-ups by using resistance for the weight load so that the athlete 12 is able to do weight bearing exercises while alone without the need for a spotter. The exercise device for push ups 10 can be made out of any suitable material such as metal, plastic or wood and is comprised of the base 14 with one or more of the sockets 34 attached. A base 14 is about 0.19 inches thick and measures about 6 inches by 20 inches. The base 14 has a raised center portion with a cut out area that contains the pin 32. Pin 32 is about 0.19 inches in diameter and is about 1.75 inches in length. The purpose of pin 32 is to serve as a connection point for the resistance band 24. Further, attached to the base 14 is a pair of handles 18 via socket 34. A socket 34 may be a cylinder about 1 inch inside diameter and about 2 inches in height. The base 14 also has a friction material 16 adhered to its bottom, in one or more places, to improve stable contact with a floor surface.

A handle 18 sets in a socket 34 and is able to rotate as much as 360 degrees about the axis of the socket, which is preferably orthogonal to the base 14, to allow athlete 12 to position hands in anyway desired to perform various exercises. The handle 18 is about 1 inch outside diameter and is about 5 inches in height and about 8 inches in length. The hand support 30 is attached to a handle 18 and is about 6 inches in length and about 3.5 inches in diameter. The top of a hand support 30 is covered with a resilient material such as foam rubber. The friction cap 20, which may be made of foam material, is inserted on one end of handle 18 to make secure contact with the floor surface.

The harness 26 is made out of any suitable material such as woven fabric, leather or plastic and is comprised of an interconnected belt, shoulder straps and buckles made to fit the human form with the harness eye hook 28 attached at the front. The harness 26 is coupled to the base 16 with one or more resistance bands 24. The resistance band 24 is preferably made out of any suitable material such as rubber or elastomer and has a cross section that measures about 0.5 inches by 0.75 inches and is about 6 inches in length. A resistance band 24 has attachment holes at each end to contain the eye hook 22. An eye hook 22 is constructed from about 0.19 inches thick bent rod and is about 1.5 inches by 2.5 inches and has a movable portion to allow connection with a pin 32 and a harness eye hook 28.

The present invention is described further in the following Example, which is set forth to aid in the understanding of the invention, and should not be construed to limit in any way the scope of the invention as defined in the claims which follow thereafter.

Example

An athlete 12 puts on a harness 26 and attaches one or more resistance bands 24 with eye hooks 22 to a harness eye hook 28. The athlete 12 then moves to the vicinity of the base 14 and secures an eye hook 22 to a pin 32. The hands of athlete 12 are then placed on hand supports 30 which can be moved into any desirable position before starting an exercise. The athlete 12 can perform a variety of exercises in a horizontally prone position, with the floor, by supporting the body with the hands, on hand supports 30, and pushing the body away from the floor, placing resistance on a resistance band 24 connected to a harness 26 increasing the work load above that of an unassisted push-up.

FIGS. 1 through 3 are conceptual illustrations allowing for an explanation of the present invention. Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. An exercise device for push-ups comprising:

one or more handles;

a base comprising one or more sockets extending essentially orthogonally from a plane of the base, the one or more sockets adapted for insertion of the one or more handles into the socket;

a harness including an interconnected belt and at least one shoulder strap; and one or more resistance bands connected to the base and the harness.

2. The exercise device of claim 1 wherein the base includes friction material adhered to the bottom of the base.

3. The exercise device of claim 1 wherein the handle includes a friction cap inserted at one end of the one or more handles.

4. The exercise device of claim 1 wherein the one or more handles is adapted to rotate up to 360 degrees about an axis of the one or more sockets.

5. The exercise device of claim 1 wherein the harness is constructed of one of woven fabric, leather, and plastic.

6. The exercise device of claim 1 wherein the one or more resistance bands are constructed of one of rubber and elastomer material.

7. The exercise device of claim 1 wherein the one or more resistance bands are removably coupled to the base and the harness.

8. The exercise device of claim 1, wherein one or more resistance bands are coupled to the base and the harness with one or more eye hooks that include a movable portion to allow connection with a pin on the base.

9. The exercise device of claim 1 wherein the base measures about 6 inches by about 20 inches.

10. The exercise device of claim 1 wherein the one or more handles are tubular members having an inverted U shape.

11. The exercise device of claim 10 wherein the one or more handles are about 5 inches in height and about 8 inches in length.

12. The exercise device of claim 1 wherein the one or more handles comprise a hand support that is about 6 inches in length and about 3.5 inches in diameter.

13. The exercise device of claim 1 wherein the one or more resistance band measures about 0.5 inches in width and 6 inches in length.

14. The exercise device of claim 1 wherein the one or more sockets comprise a cylinder about 1 inch inside diameter and about 2 inches in height.

* * * * *